United States Patent [19]

Gross et al.

[11] 4,226,674

[45] Oct. 7, 1980

[54] METHOD OF FORMING A TEXTURED FIBERBOARD

[75] Inventors: William G. Gross, York; Robert H. Hutchinson, Lancaster, both of Pa.

[73] Assignee: Armstrong Cork Company, Lancaster, Pa.

[21] Appl. No.: 969,107

[22] Filed: Dec. 13, 1978

[51] Int. Cl.[2] ..... D21F 11/06; D21F 11/12

[52] U.S. Cl. ..... 162/109; 162/217

[58] Field of Search ..... 162/109, 205, 209, 210, 162/211, 217, 305, 311, 314, 330, 335

[56] References Cited

U.S. PATENT DOCUMENTS

| | | | |
|---|---|---|---|
| 941,561 | 11/1909 | Decker | 162/335 |
| 1,724,154 | 8/1929 | Williams et al. | 162/335 X |
| 1,831,599 | 11/1931 | Hussey | 162/217 X |
| 3,216,891 | 4/1965 | Kozich | 162/210 X |
| 3,255,073 | 6/1966 | Enslen et al. | 162/209 |
| 3,511,744 | 5/1970 | Garrett, Jr. | 162/109 X |

*Primary Examiner*—Richard V. Fisher

[57] ABSTRACT

The invention is a process for forming a fiberboard structure with a rough textured surface on a conventional Oliver forming machine. The machine is operated in such a manner as to prevent the dispersion of the fibers in the slurry and to permit the fibers to build up in a lumpy and irregular manner on the rotary vacuum cylinder of the Oliver machine. Also the vacuum of the rotating clyinder is on a low vacuum level of 3–5 inches of mercury and the slurry level is maintained at point 5 inches below the center line of the rotating cylinder. There is thereby formed a fiberboard structure which has a very rough surface texture.

1 Claim, No Drawings

METHOD OF FORMING A TEXTURED FIBERBOARD

BACKGROUND OF THE INVENTION

1. Field of the Invention

The invention is directed to a technique for forming a fiberboard structure and, more particularly, to a technique for forming a fiberboard structure in a conventional Oliver machine.

2. Description of the Prior Art

Conventional Oliver forming machines are shown in U.S. Pat. Nos. 1,724,154; 1,831,599; and 3,511,744.

The invention herein is directed to the taking of a conventional Oliver machine and modifying its operation so that it does not form a smooth surface, uniformly built up fiberboard mat such as one normally desires to secure from an Oliver machine.

SUMMARY OF THE INVENTION

The invention is directed to a process for forming a fiberboard structure with a rough textured surface. The operation of a conventional Oliver machine is modified so that the machine operates at a vacuum of only 3—5 inches of mercury. The slurry level is kept at a very low level below the center line of the rotating vacuum cylinder, the conventional slurry agitation device is decreased in use until such time as the normal slurry fibers tend to lump together, and finally, no contact or pressure is applied to the surface of the formed mat in order to flatten out its rough texture.

All of the steps taken to modify the conventional manner of operating the Oliver machine are contrary to the normal manner of operating the Oliver machine since one normally desires to secure from the Oliver machine a flat mat containing a uniformly built up fiber structure.

DESCRIPTION OF THE PREFERRED EMBODIMENT

The invention is directed to a process for forming a fiberboard structure with a rough textured surface. The fiberboard structure is formed on a conventional Oliver single cylinder vacuum machine which normally has a rotating cylinder partially immersed in a reservoir containing a slurry of fibrous material. The rotating cylinder has vacuum chambers so that when the slurry is brought in contact with the cylinder, the water of the slurry passes into the vacuum chambers of the cylinder and a fibrous material is formed on the surface of the cylinder to form a fibrous mat. After the cylinder surface leaves the slurry, the deposited fiber structure on the circumference of the cylinder is removed, and this forms the fiberboard structure or wet mat that one normally desires to form on a conventional Oliver machine. Up to this point, the inventive method herein involves the use of a conventional Oliver machine which is shown in any one of the above-mentioned prior art patents.

The invention herein involves the following changes to the normal operation of the Oliver machine.

Normally, the Oliver machine is operated with a vacuum in the cylinder from 10–18 inches of mercury. Herein, the machine is operated with the vacuum of the rotating cylinder at a low level of 3–5 inches of mercury.

Normally, the slurry level in the reservoir containing the cylinder is above the midpoint of the cylinder, though on some occasions it may be operated below the midpoint of the cylinder. Herein, the slurry level is maintained in the reservoir at a point about 5 inches below the center line of the rotating cylinder.

In the conventional Oliver machine there is always provided agitation means to keep the slurry stirred up so that the fibers are uniformly distributed throughout the slurry. Herein, the operation of the conventional agitating means are cut back so that there is a decrease in the normal slurry liquid agitation to the point that clumps of fibrous material are now formed in the slurry.

Finally, in the normal operation of the Oliver machine, the fiberboard formed on the Oliver machine is passed through conventional post-pressing operations which remove water from the slurry and smooth the surface of the mat formed in the Oliver machine. Herein, there must be no contacting of the surface of the fibrous mat formed by any type of pressure roll structure so as to alter the surface texture of the mat formed on the rotating cylinder.

Normally, a conventional fiberboard slurry is utilized, such as is conventional in the art for forming ceiling board products. A typical example of a mix that may be used to form the slurry is as follows:

| Component | Parts by Weight |
|---|---|
| refined ground wood | 64.0–90.0 |
| mineral wool fiber | 5.0–25.0 |
| chopped glass fiber, ½ - 1 inch long | 0.25–1.0 |
| binder (starch) | 5.0–10.0 |

The refined ground wood is basically the fibrous material which is used to form the mat. The mineral wool is included to enhance water drainage. The glass fiber is added to provide wet strength and to promote a uniformly tufted texture on the surface. The binder is a conventional binder in the art. The above formulation is added to water to form a slurry which has about 2%–4% solids content in the water (2%–4% of the above components in the slurry).

The slurry is formed in the conventional manner, and the Oliver is operated at its conventional speed and conditions with the exception that, as indicated above, the vacuum is cut back, the slurry level is lowered, the slurry agitation is diminished, and no post consolidation is carried out.

A modification of the invention herein may involve a slight softening of the texture formed on the surface of the board product by providing a 1–4 lbs/linear inch roll pressure on the finished surface of the fiberboard. This means that the surface is very lightly touched by a roll to help soften the roughness of the surface formed in the Oliver machine operated as above set forth. Normally, the post pressing operations of a board formed in the Oliver will have roll pressures ranging from 100 to 400 lbs/linear inch of roll.

What is claimed is:

1. A process for forming a fiberboard structure with a rough textured surface, wherein said board is formed on the conventional Oliver single cylinder vacuum machine which has a rotating cylinder partially immersed in a reservoir containing a slurry of fibrous material, said cylinder having vacuum chambers therein so that when the slurry is brought in contact with the cylinder, the water of the slurry passes into the vacuum chambers of the cylinder and the fibrous material is deposited on the surface of the cylinder to form a fibrous mat, comprising the steps of:

(a) placing the fiber slurry in the reservoir containing the vacuum cylinder and rotating said cylinder in said slurry to draw water into the vacuum chambers of the cylinder and cause the fibrous material of the slurry to deposit upon the outer surface of said cylinder.

(b) the improvement comprising:

(1) operating the vacuum of the rotating cylinder on a low vacuum level of 3–5 inches of mercury, (2) maintaining the slurry level in the reservoir containing the cylinder at a point about 5 inches below the center line of the rotating cylinder, (3) decreasing the normal slurry liquid agitation to a point where clumps of fibrous material are formed in the slurry, and (4) not contacting the surface of the fibrous mat formed with any type of pressure roll structure so as to dewater the board or to smooth the surface texture of the mat formed on the rotating cylinder.

* * * * *